US008915009B2

(12) United States Patent
Caulk et al.

(10) Patent No.: US 8,915,009 B2
(45) Date of Patent: Dec. 23, 2014

(54) MODULAR SIGHTING AND LIGHTING SYSTEM FOR HANDGUNS

(75) Inventors: Michael J. Caulk, Wilsonville, OR (US); Danny Anderson, Wilsonville, OR (US); Lewis A. Danielson, Wilsonville, OR (US)

(73) Assignee: Crimson Trace Corporation, Wilsonville, OR (US)

( * ) Notice: Subject to any disclaimer, the term of this patent is extended or adjusted under 35 U.S.C. 154(b) by 0 days.

(21) Appl. No.: 13/298,253

(22) Filed: Nov. 16, 2011

(65) Prior Publication Data

US 2012/0124885 A1 May 24, 2012

Related U.S. Application Data

(60) Provisional application No. 61/414,385, filed on Nov. 16, 2010.

(51) Int. Cl.
*F41G 1/00* (2006.01)
*F41G 1/35* (2006.01)
*F41G 11/00* (2006.01)

(52) U.S. Cl.
CPC ..... *F41G 1/35* (2013.01); *F41G 11/001* (2013.01); *F41G 11/003* (2013.01)
USPC ..... 42/146; 42/114; 42/124; 42/90

(58) Field of Classification Search
CPC ..... F41G 1/35; F41G 11/001; F41G 11/003
USPC ..... 42/146, 114, 124, 90
See application file for complete search history.

(56) References Cited

U.S. PATENT DOCUMENTS

| | | | | |
|---|---|---|---|---|
| 2,385,649 | A * | 9/1945 | Prideaux | 42/132 |
| 5,056,254 | A * | 10/1991 | Bechtel | 42/114 |
| 5,435,091 | A | 7/1995 | Toole et al. | |
| 5,581,898 | A * | 12/1996 | Thummel | 42/117 |
| 5,590,486 | A * | 1/1997 | Moore | 42/114 |
| 5,685,105 | A * | 11/1997 | Teetzel | 42/146 |
| 5,706,600 | A * | 1/1998 | Toole et al. | 42/115 |
| 5,758,448 | A * | 6/1998 | Thummel | 42/114 |
| 6,378,237 | B1 * | 4/2002 | Matthews et al. | 42/124 |
| 6,393,752 | B1 * | 5/2002 | Oliver et al. | 42/114 |
| 6,578,311 | B2 * | 6/2003 | Danielson et al. | 42/114 |
| 7,225,577 | B1 * | 6/2007 | Wang | 42/124 |
| 7,240,452 | B2 * | 7/2007 | Ho | 42/124 |
| 7,260,910 | B2 | 8/2007 | Danielson | |
| 7,260,912 | B2 * | 8/2007 | Liu | 42/127 |

(Continued)

*Primary Examiner* — Michelle R Clement

(74) *Attorney, Agent, or Firm* — Schwabe, Williamson & Wyatt, P.C.

(57) ABSTRACT

Embodiments provide modular illumination systems that may be used with any handgun platform, and are not specific to any make or model. Some embodiments may provide lighting, for instance visible light and/or infrared light for use in low light or dark environments. Also provided in various embodiments are aiming and/or sighting systems that may be equipped with an IR sight or a laser sight, such as a red or green laser. In various embodiments, the illumination modules may couple to the handgun via a mounting member that is integral to the handgun body, and the mounting member may be recessed or otherwise concealed and/or protected by the handgun body. Thus, in various embodiments, no portion of the mounting member (or the corresponding mounting element on the illumination module) is exposed or visible when the illumination module is coupled to the mounting member, and a conventional holster may be used.

10 Claims, 12 Drawing Sheets

(56) References Cited

U.S. PATENT DOCUMENTS

| | | | | |
|---|---|---|---|---|
| 7,275,344 | B2 * | 10/2007 | Woodmansee et al. | 42/146 |
| 7,305,790 | B2 * | 12/2007 | Kay | 42/146 |
| 7,438,430 | B2 * | 10/2008 | Kim | 362/110 |
| 7,472,830 | B2 | 1/2009 | Danielson | |
| D603,478 | S | 11/2009 | Hughes | |
| D616,957 | S | 6/2010 | Rievley et al. | |
| 7,743,547 | B2 | 6/2010 | Houde-Walter | |
| 7,805,876 | B1 | 10/2010 | Danielson et al. | |
| D636,049 | S | 4/2011 | Hughes et al. | |
| D636,837 | S | 4/2011 | Hughes et al. | |
| 7,954,273 | B1 * | 6/2011 | Swan | 42/115 |
| 7,987,627 | B2 * | 8/2011 | Woodmansee et al. | 42/146 |
| 8,028,461 | B2 | 10/2011 | NuDyke | |
| 8,256,154 | B2 * | 9/2012 | Danielson et al. | 42/146 |
| 2002/0100202 | A1 * | 8/2002 | Lin et al. | 42/114 |
| 2002/0104249 | A1 * | 8/2002 | Lin et al. | 42/114 |
| 2002/0148153 | A1 * | 10/2002 | Thorpe | 42/114 |
| 2003/0029073 | A1 * | 2/2003 | Danielson et al. | 42/146 |
| 2004/0045209 | A1 * | 3/2004 | Nielsen | 42/146 |
| 2005/0257415 | A1 * | 11/2005 | Solinsky et al. | 42/146 |
| 2006/0156609 | A1 * | 7/2006 | Kim | 42/124 |
| 2007/0113462 | A1 * | 5/2007 | Ho | 42/146 |
| 2011/0047850 | A1 | 3/2011 | Rievley et al. | |
| 2011/0061283 | A1 * | 3/2011 | Cavallo et al. | 42/72 |
| 2011/0162251 | A1 * | 7/2011 | Houde-Walter | 42/146 |
| 2011/0232151 | A1 * | 9/2011 | Zukowski | 42/114 |
| 2012/0124885 | A1 * | 5/2012 | Caulk et al. | 42/146 |
| 2012/0144718 | A1 * | 6/2012 | Danielson et al. | 42/117 |

* cited by examiner

MODULAR SIGHTING AND LIGHTING SYSTEM FOR HANDGUNS

CROSS REFERENCE TO RELATED APPLICATION

This application claims benefit of the filing date of U.S. Provisional Application No. 61/414,385, filed Nov. 16, 2010, the disclosure of which is incorporated herein in its entirety.

TECHNICAL FIELD

Embodiments herein relate to the field of firearm accessories, and, more specifically, to modular sighting and lighting devices for handguns.

BACKGROUND

Lasers are used in many firearms applications as tools to enhance targeting. For example, one form of firearm sight makes use of a laser placed on a handgun or a rifle and aligned to emit a beam parallel to the barrel. Since a laser beam by definition has low divergence, the laser light appears as a small spot even at long distances. The user places the spot on the desired target and the barrel of the gun is aligned (but not necessarily allowing for bullet drop or movement of the target while the bullet travels). Most laser sights use a red or green laser diode. Others use an infrared (IR) diode to produce a dot invisible to the naked human eye but detectable with night vision devices.

Lighting devices also may be used with firearms in order to illuminate the field or stun the target. Such lighting devices may include visible (e.g., white) lights and/or infrared lights, for instance for use in low lighting conditions with night vision goggles. However, laser sights and illumination devices can be bulky and awkward to use, and can render the firearm incompatible with a holster. They can also be difficult to mount on the firearm, and can be expensive.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1A:
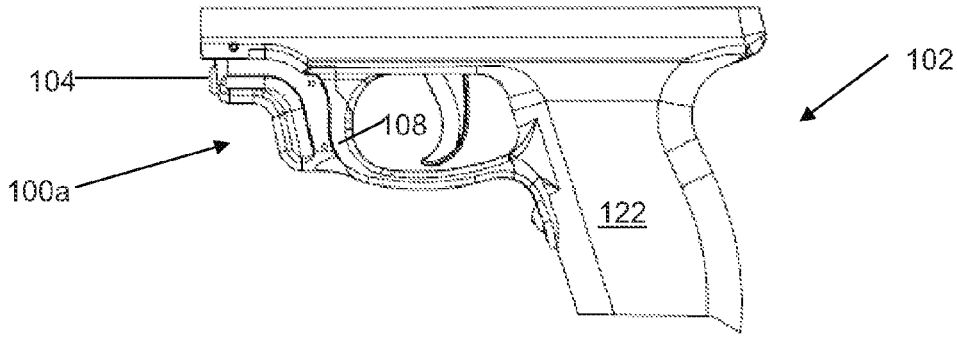
FIGS. 1A-C illustrate side views of three examples of interchangeable, vertical rail-mounted modular illumination devices, including a sighting module (FIG. 1A), a lighting module (FIG. 1B), and a dummy module (FIG. 1C), in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

In various embodiments, modular illumination systems are provided for use on handguns. In various embodiments, the modular illumination systems disclosed herein may be used with any handgun platform, and are not specific to any particular make or model of handgun. Some embodiments of the systems may provide lighting, for instance visible (e.g., white) light for illuminating a field of use with visible light, and/or infrared (IR) light for use in low light or dark environments, for instance with a night vision device such as night vision goggles. Also provided in various embodiments are aiming and/or sighting systems, for instance which may be equipped with an IR sight or a laser sight, such as a red or green laser.

In various embodiments, the illumination modules may couple to the handgun via a mounting member that is integral to the handgun body. For instance, the handgun may be equipped with an integral male or female mounting rail component, such as a vertical or horizontal rail that is integral to the barrel or trigger guard, and the module may be equipped with a corresponding female or male mounting rail element. In various embodiments, the mounting member on the handgun may be recessed or otherwise concealed and/or protected by the handgun body, such that no portion of the mounting member (or the corresponding mounting element on the illumination module) is exposed or visible when the illumination module is coupled to the mounting member.

Thus, in various embodiments, no portion of the mounting mechanism may be exposed or otherwise project from the handgun body when the module is coupled to the handgun, which reduces the likelihood that the module will become snagged or otherwise become an encumbrance during use. In particular embodiments, the smooth outer contour of the system, combined with the compact housing and streamlined placement of the illumination module on the handgun, may allow the use of a conventional holster. In various embodiments, the low-profile design of the illumination system also may render the system sturdy and resistant to breakage, and may not interfere with aiming or firing.

In various embodiments, the illumination systems described herein may further include a power source, such as a battery, an activation switch, and control circuitry, all of which may be adapted to provide power to and control operation of the illumination module. In some embodiments, the activation switch may be positioned at the base of the trigger guard, and along the front side of the handgun grip, such that the fingers of a user will naturally and intuitively activate the illumination module when the user's hand tightens on the grip, for instance when preparing to pull the trigger.

Figure 1B:
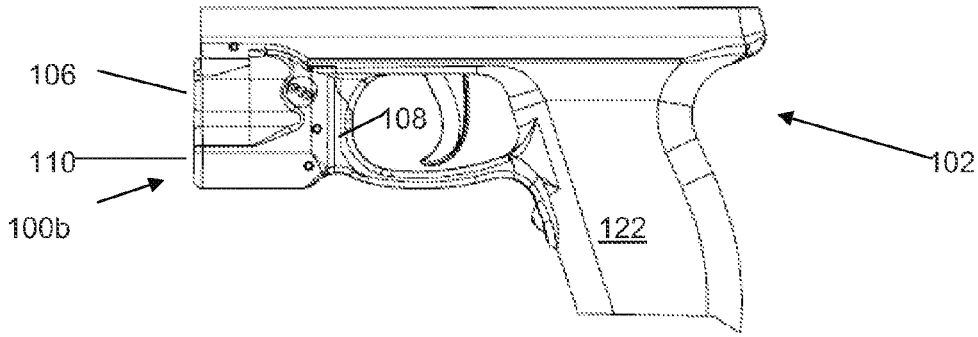
Figure 1C:
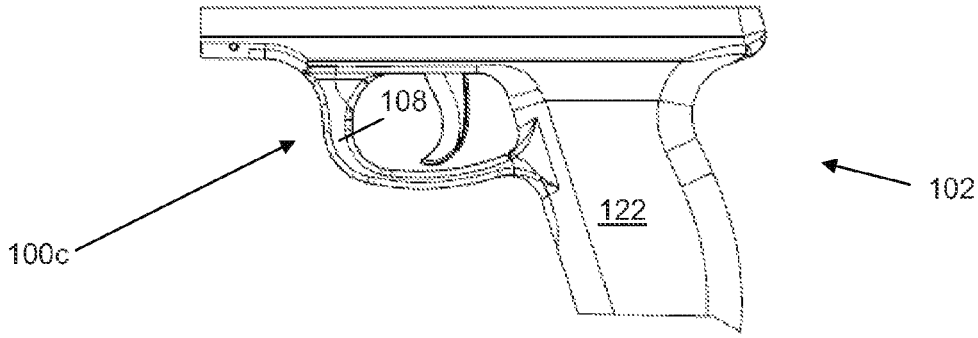

FIGS. 1A-C illustrate side views of three examples of interchangeable, vertical rail-mounted modular illumination devices, including a sighting module (FIG. 1A), a lighting module (FIG. 1B), and a dummy module (FIG. 1C), in accordance with various embodiments. Turning now to FIG. 1A, in various embodiments, an illumination module 100*a* may be removably coupled to a handgun 102, for instance in a low-profile fashion in front of the trigger guard 108, and generally aligning with the underside of the barrel (not shown). In some embodiments, a portion of illumination module 100*a* may generally align with and/or couple to at least a portion of trigger guard 108, and may terminate at or near the grip 122 of handgun 102.

As illustrated in FIGS. 1A and 1B, in some embodiments, the illumination module 100*a* may be a single illumination module. For example, the illumination module 100*a* illustrated in FIG. 1A is a sighting device that includes a single laser source 104, such as an IR, red, or green laser diode. One of skill in the art will appreciate that although a single laser source 104 is illustrated in this example, the device could also be modified to accommodate another laser source to create a dual laser module, and/or the device could be modified to include a lighting source, such as an IR light or an LED light.

In other embodiments, such as the embodiment illustrated in FIG. 1B, the illumination module 100*b* may be a lighting module. For example, the illustrated illumination module includes a lighting source 106, such as an LED or IR light source, and may also include a battery compartment 110, for instance to accommodate a larger battery than the device shown in FIG. 1A, which uses a small battery (not shown). Although the illustrated example includes a single lighting source 106, one of skill in the art will appreciate that the illumination module 100*b* also could be modified to also include one or more sighting devices, such as an IR, red, or green laser, or an additional lighting device, such as an IR light or an LED light.

Turning now to FIG. 1C, in some embodiments, the system may also include a dummy module 100*c*, which may also be referred to herein as a placeholder module. In some embodiments, such a dummy module 100*c* may contain no lights or sights, but may be used when no illumination module is coupled to the handgun 102, for instance to conceal and/or protect the mounting member components.

In various embodiments, the illumination modules 100*a*, 100*b*, 100*c* may be configured to be swappable by the user, and may be designed to be upgradable. For instance, the unit may be sold, in some embodiments, with a sighting module 100*a*, but may be upgradable to also include a lighting module 100*b*. In other embodiments, the unit may be sold with two or more interchangeable modules 100*a*, 100*b*, so that the user may select the lighting or sighting functions appropriate to the task at hand. In still other embodiments, the unit may be sold with only the dummy module 100*c*, but may be upgraded by separate purchase of additional modules.

Figure 2A:
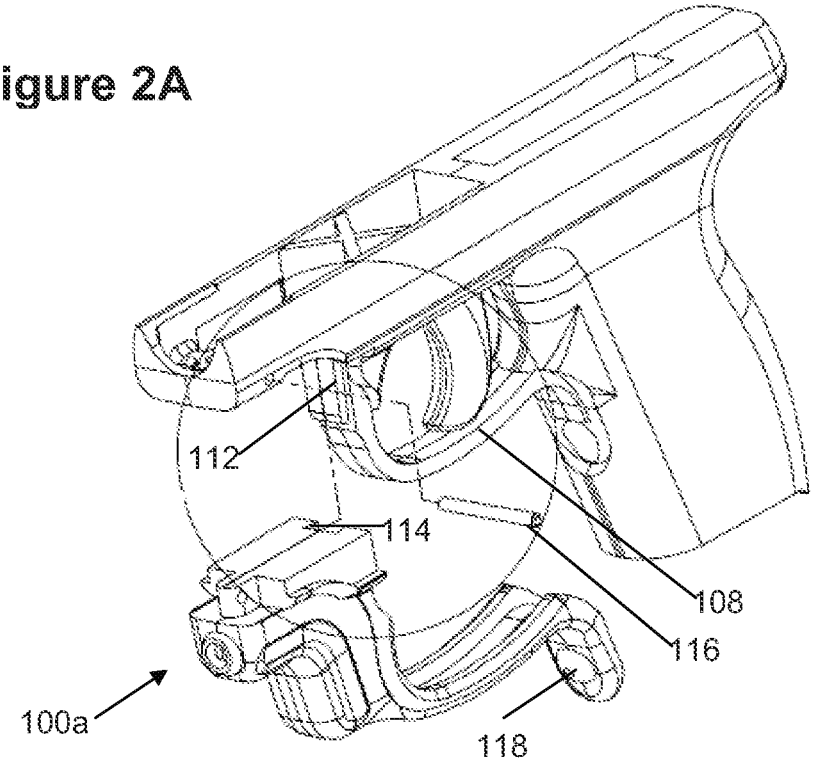
FIGS. 2A-C illustrate perspective views of the three interchangeable, vertical rail-mounted modular illumination devices illustrated in FIGS. 1A-C, including a sighting module (FIG. 2A), a lighting module (FIG. 2B), and a dummy module (FIG. 2C), in accordance with various embodiments.
Figure 2B:
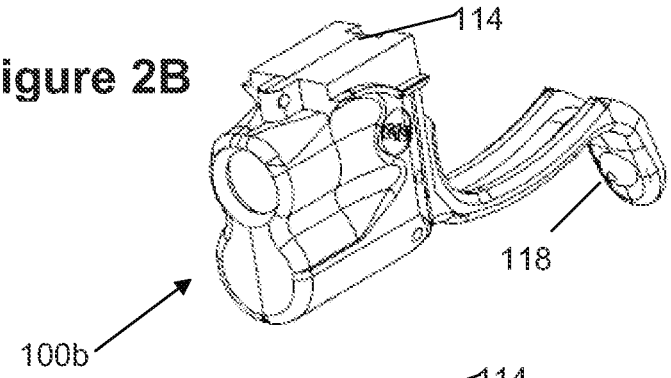
Figure 2C:
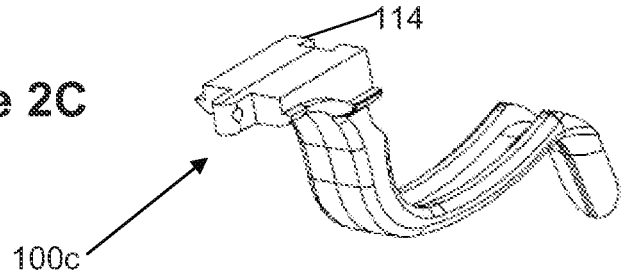

FIGS. 2A-C illustrate perspective views of the three interchangeable, vertical rail-mounted modular illumination devices illustrated in FIGS. 1A-C, including a sighting module (FIG. 2A), a lighting module (FIG. 2B), and a dummy module (FIG. 2C), in accordance with various embodiments. Turning now to FIGS. 2A and 2B, in various embodiments, illumination module 100*a*/100*b* may be adapted to couple to a vertical mounting member 112 such as a rail that may be positioned on the front of the trigger guard 108. In various embodiments, illumination module 100*a*/100*b* may include a corresponding mounting element 114 that may be configured to engage mounting member 112. Although the illustrated embodiment shows mounting member 112 as a male component and mounting element 114 as a corresponding female component, one of skill in the art will appreciate that these components may be reversed, with mounting member 112 as the female component and mounting element 114 the corresponding male component.

In some embodiments, a user may couple illumination module 100*a* to mounting member 112 by aligning in corresponding mounting components 112, 114, and sliding illumination module 100*a* vertically along mounting member 112, for instance until illumination module 100*a* seats firmly against trigger guard 108. In some embodiments, a retaining member 116 such as a button, fastener, or quick release pin may be provided to retain the module.

Figure 3:
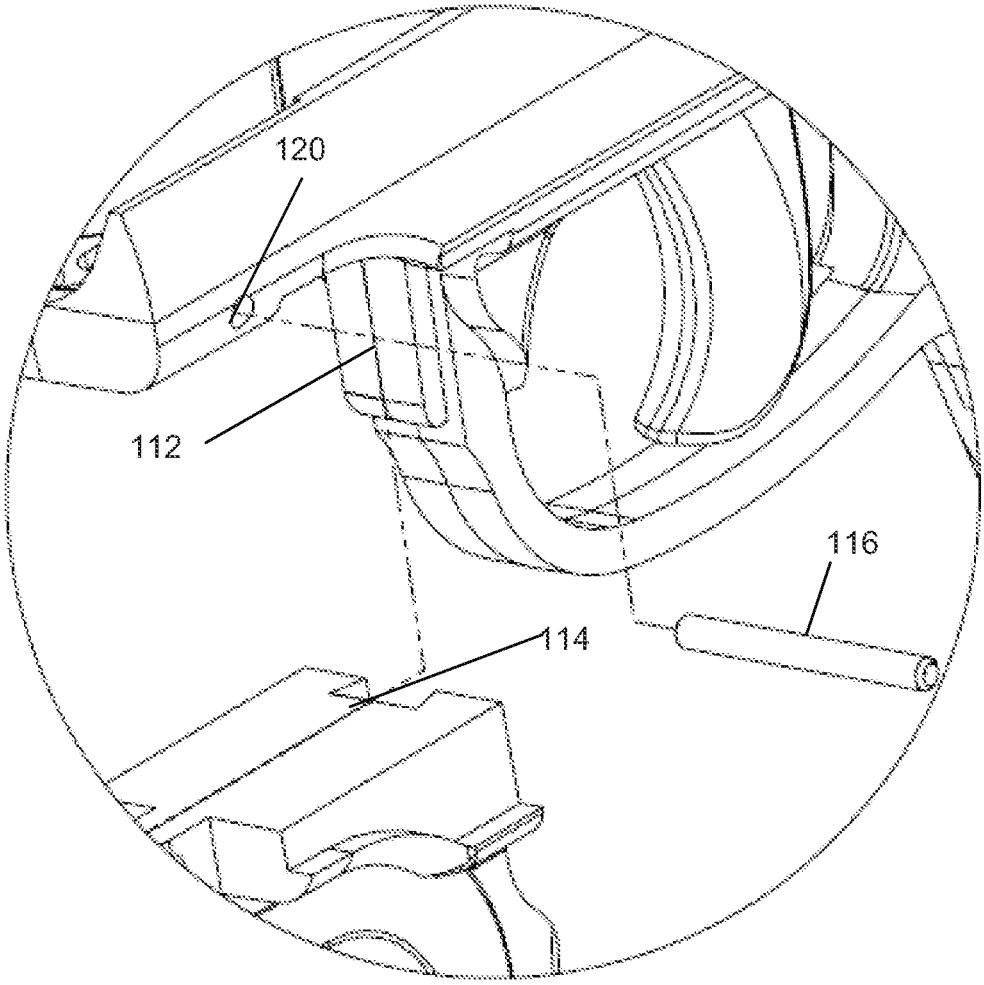
FIG. 3 illustrates a close-up view of the coupling mechanism of the sighting module shown in FIG. 2A, in accordance with various embodiments.

In particular embodiments, a switch 118 may be provided that may be positioned at the base of trigger guard 108, where a user's middle, ring, and/or pinky finger will fall naturally during operation of the trigger. In some embodiments, positioning switch 118 in this manner may allow intuitive activation of illumination module 100*a* when a user's hand tightens around the handgun in preparation for firing. As illustrated in FIGS. 2B and 2C, illumination module 100*b* also may be equipped with mounting element 114 and switch 118, and dummy module 100*c* may be equipped with mounting element 114 for mounting to mounting element 112, but may not include a switch. FIG. 3 illustrates a close-up view of the coupling mechanism of the sighting module shown in FIG. 2A, including mounting element 114, mounting member 112, retaining member 116, and retaining member receiving hole 120. In various embodiments, once illumination module 100*a* has been mounted, retaining member 116 may be employed, such as by inserting retaining member 116 into receiving hole 120, in order to lock illumination module 100*a* in place for use.

Figure 4A:
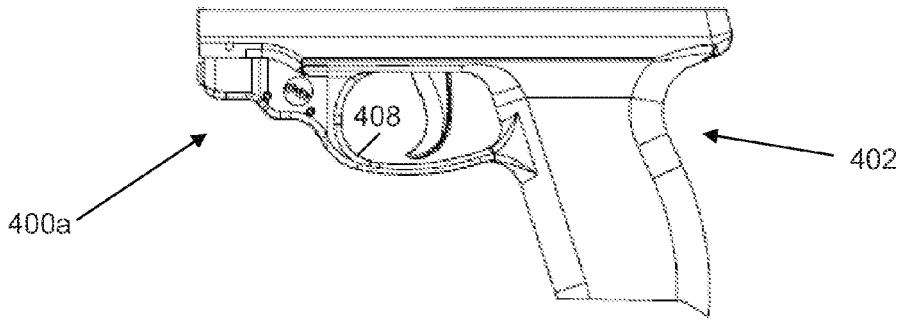
FIGS. 4A-C illustrate side views of three interchangeable, vertical rail-mounted modular illumination devices, including a sighting module (FIG. 4A), a lighting module (FIG. 4B), and a dummy module (FIG. 4C), in accordance with various embodiments.
Figure 4B:
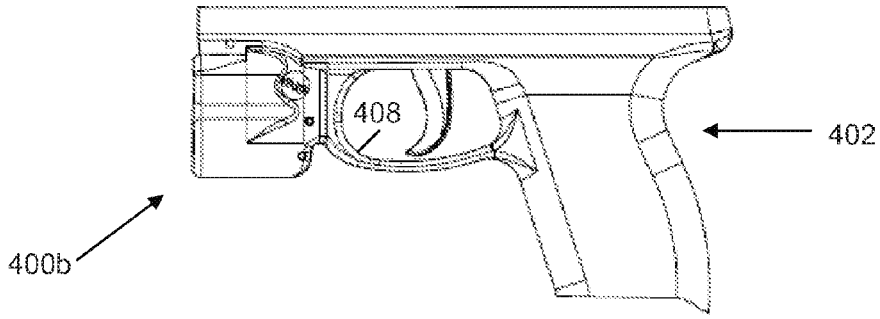
Figure 4C:
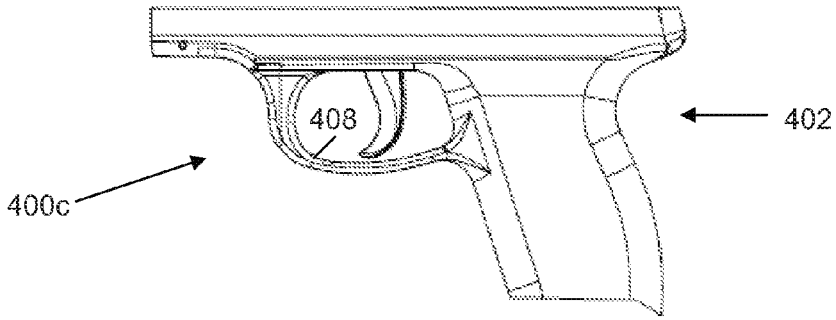
Figure 5A:
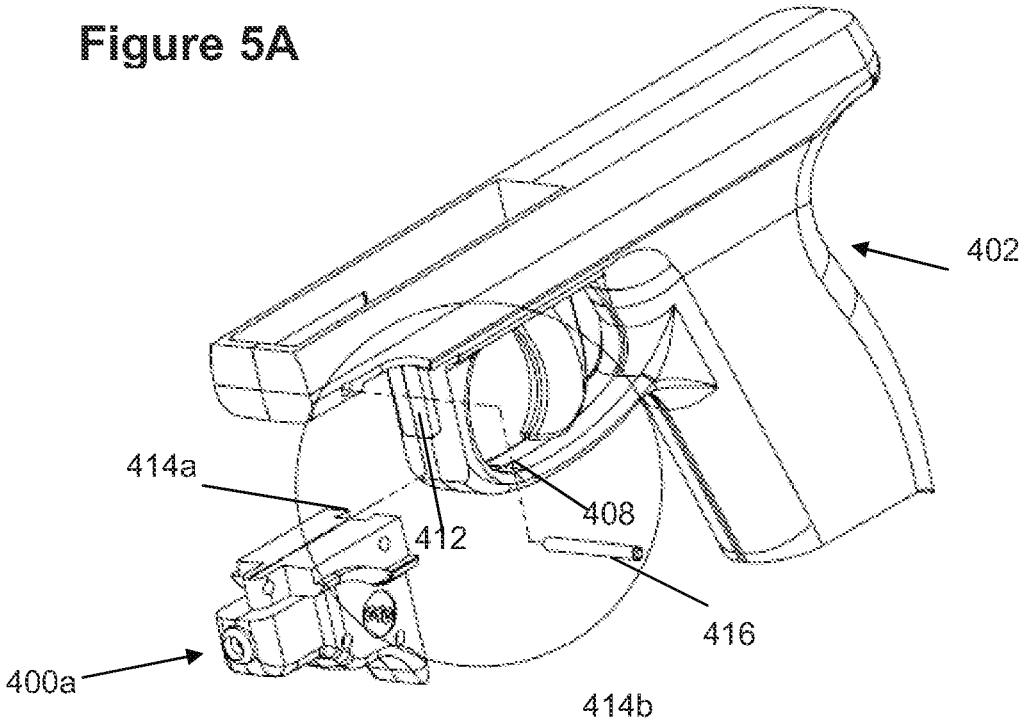
FIGS. 5A-C illustrate perspective views of the three interchangeable, vertical rail-mounted modular illumination devices illustrated in FIGS. 4A-C, including a sighting module (FIG. 5A), a lighting module (FIG. 5B), and a dummy module (FIG. 5C), in accordance with various embodiments.
Figure 5B:
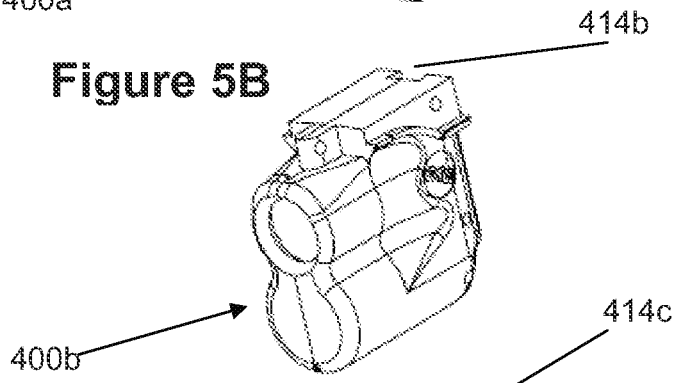
Figure 5C:
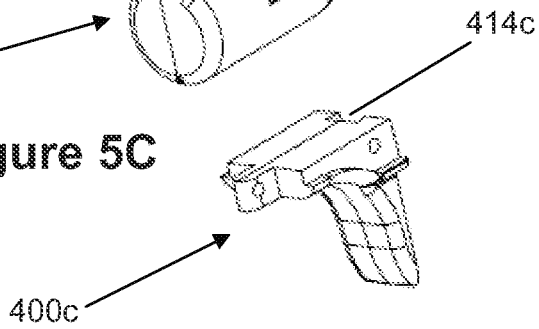
Figure 6:
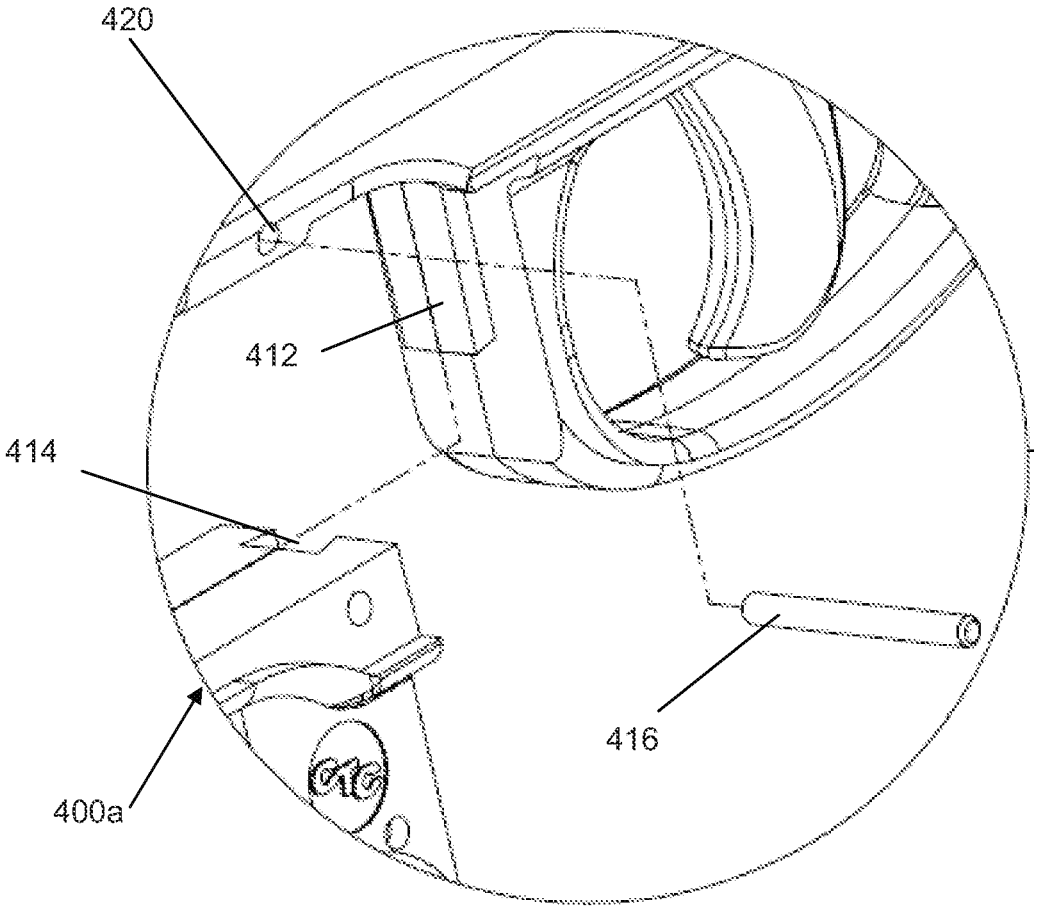
FIG. 6 illustrates a close-up view of the coupling mechanism of the sighting module shown in FIG. 5A, in accordance with various embodiments.

Although the modular illumination devices of FIGS. 1-3 are depicted as wrapping around the length of the trigger guard and terminating at the grip, in other embodiments, more compact modular illumination devices may be used. For example, FIGS. 4A-C illustrate side views of three interchangeable, compact, vertical rail-mounted modular illumination devices, including a sighting module (FIG. 4A), a lighting module (FIG. 4B), and a dummy module (FIG. 4C); FIGS. 5A-C illustrate perspective views of the three interchangeable, vertical rail-mounted modular illumination devices illustrated in FIGS. 4A-C, including a sighting module (FIG. 5A), a lighting module (FIG. 5B), and a dummy module (FIG. 5C); and FIG. 6 illustrates a close-up view of the coupling mechanism of the sighting module shown in FIG. 5A, all in accordance with various embodiments. Like the illumination modules illustrated in FIGS. 1-3, the illumination modules illustrated in FIGS. 4A-C may be removably coupled to a handgun 402, for instance in a low-profile fashion in front of the trigger guard 408, and generally aligning with the underside of the barrel (not shown). In some embodiments, a portion of illumination modules 400*a*/400*b* and/or dummy module 400*c* may generally align with and/or couple to a portion of trigger guard 408, but generally may not extend far along the outer contour of trigger guard 408 towards the grip, and may not include a switch mounted at or near the grip, as do the illumination modules of FIGS. 1-3.

Turning now to FIGS. 5A and 5B, in various embodiments, illumination module 400*a*/400*b* and dummy module 400*c* may be adapted to couple to a vertical mounting member 412 such as a rail that may be positioned on the front of the trigger guard 408. In various embodiments, illumination module 400*a*/400*b* and dummy module 400*c* may include a corresponding mounting element 414*a*/414*b*/414*c* that may be configured to engage mounting member 412. Although the illustrated embodiment shows mounting member 412 as a male component and mounting element 414*a*/414*b*/414*c* as a corresponding female component, one of skill in the art will appreciate that these components may be reversed, with mounting member 412 as the female component and mounting element 414*a*/414*b*/414*c* as the corresponding male component.

In some embodiments, a user may couple illumination module 400*a*/400*b* or dummy module 400*c* to mounting member 412 by aligning corresponding mounting components 412, 414*a*/414*b*/414*c*, and sliding illumination module 400*a*/400*b* or dummy module 400*c* vertically along mounting member 412, for instance until illumination module 400*a*/400*b* or dummy module 400*c* seats firmly against handgun 402. In some embodiments, a retaining member 416 such as a button, fastener, or quick release pin may be provided to retain the module.

FIG. 6 illustrates a close-up view of the coupling mechanism of the sighting module 400*a* shown in FIG. 5A, including mounting element 414, mounting member 412, retaining member 416, and retaining member receiving hole 420. In various embodiments, once illumination module 400*a* has been mounted, retaining member 416 may be employed, such as by inserting retaining member 416 into receiving hole 420, in order to lock illumination module 400*a* in place for use.

Figures 7A, 7B:
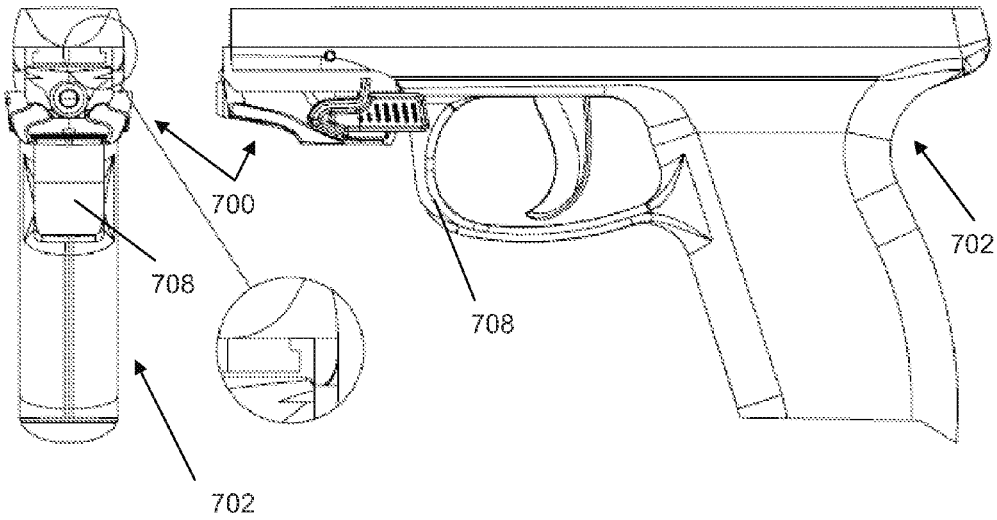
FIGS. 7A and 7B illustrate a front view (FIG. 7A) and a side view (FIG. 7B) of an example of a modular illumination device mounted on a handgun, in accordance with various embodiments.

Although the modular illumination devices of FIGS. 1-6 mount to a handgun via internal, concealed vertical rails on the front of the trigger guard, other mounting mechanisms also may be used. For example, FIGS. 7A and 7B illustrate a front view (FIG. 7A) and a side view (FIG. 7B) of an example of a modular illumination device mounted on a handgun, in accordance with various embodiments. Like the illumination modules illustrated in FIGS. 4-6, the illumination modules illustrated in FIGS. 7A and 7B may be removably coupled to a handgun 702, for instance in a low-profile fashion in front of the trigger guard 708, and generally aligning with the underside of the barrel (not shown). In some embodiments, a portion of illumination modules 700 may be positioned adjacent to a portion of trigger guard 708, but generally may not extend far along the outer contour of trigger guard 708 towards the grip. Although a sighting module is illustrated in this example, one of skill in the art will appreciate that a lighting module or dummy module also may be mounted to handgun 702 in a similar fashion.

Figure 8A:
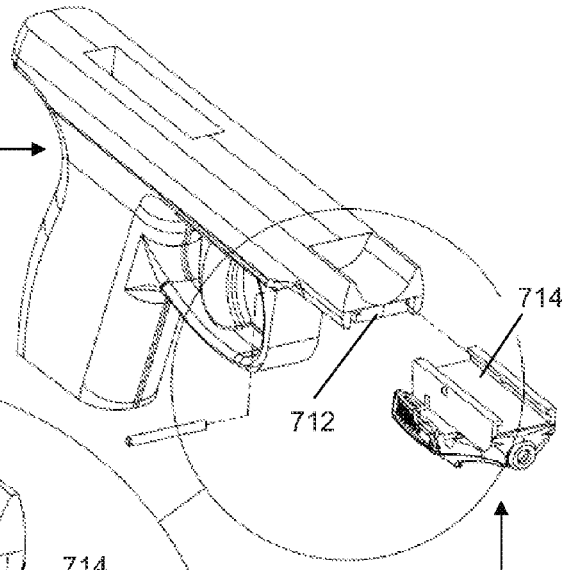
FIGS. 8A and 8B illustrate a perspective view (FIG. 8A) and a close-up view (FIG. 8B) of the modular illumination device illustrated in FIGS. 7A and 7B, in accordance with various embodiments.
Figure 8B:
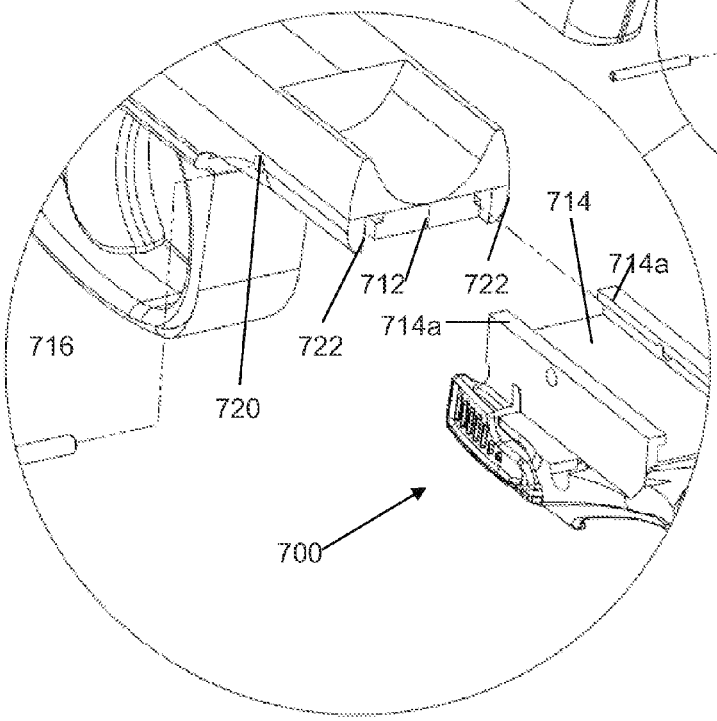

FIGS. 8A and 8B illustrate a perspective view (FIG. 8A) and a close-up view (FIG. 8B) of the horizontal rail-mounted modular illumination device illustrated in FIGS. 7A and 7B, in accordance with various embodiments. In various embodiments, illumination module 700 may be adapted to couple to a horizontal mounting member 712 such as a rail that may be positioned in front of the trigger guard 708 and on the underside of handgun 702. In various embodiments, illumination module 700 may include a corresponding mounting element 714 that may be configured to engage mounting member 712, for instance with hook-shaped side members 714*a*. Additionally, the body of handgun 702 may include side contours 722 that may protect and/or conceal mounting member 712 and/or mounting element 714 when the illumination module 700 is mounted to the handgun 702. Additionally, although the illustrated embodiment shows mounting member 712 as a male component and mounting element 714 as a corresponding female component, one of skill in the art will appreciate that these components may be reversed, with mounting member 712 as the female component and mounting element 714 the corresponding male component.

In some embodiments, a user may couple illumination module 700 to mounting member 712 by aligning corresponding mounting components 712, 714, and sliding illumination module 700 horizontally along the body of handgun 702. In some embodiments, a retaining member 716 such as a button, fastener, or quick release pin may be provided to retain the module, such as by inserting retaining member 716 into receiving hole 720 in order to lock illumination module 700 in place for use.

Figure 9A:
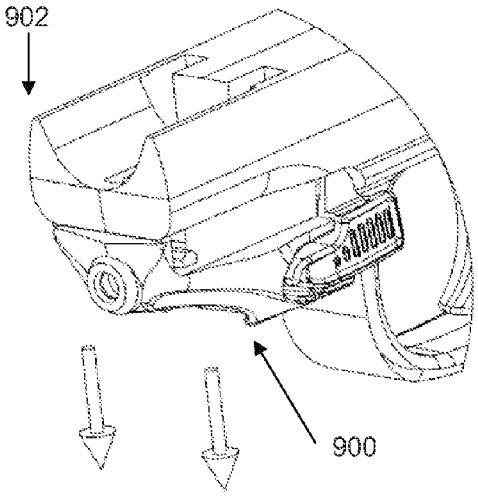
FIGS. 9A-D illustrate two perspective views (FIGS. 9A and 9B), a front view (FIG. 9C), and a longitudinal cross sectional view (FIG. 9D) of an example of a modular illumination device mounted on a handgun, in accordance with various embodiments.
Figure 9B:
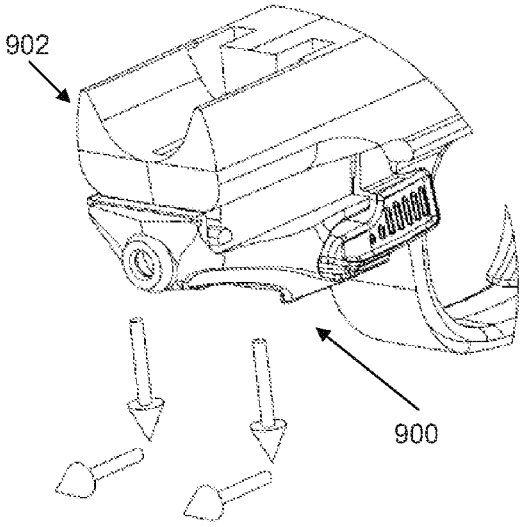
Figure 9C:
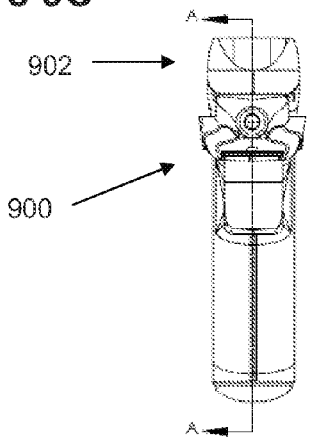
Figure 9D:
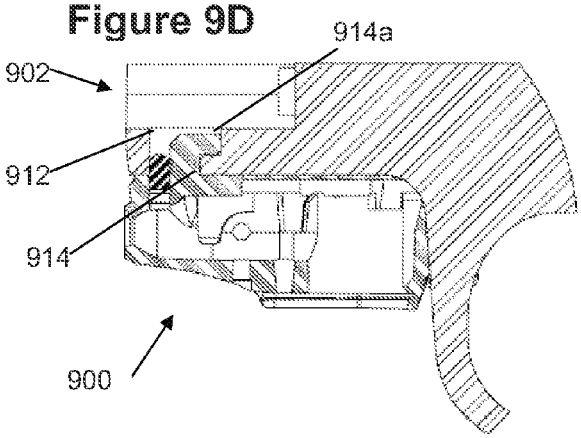

Although the modular illumination devices of FIGS. 7 and 8 mount to a handgun via internal, concealed horizontal rails in front of the trigger guard, still other mounting mechanisms also may be used. For example, FIGS. 9A-D illustrate two perspective views (FIGS. 9A and 9B), a front view (FIG. 9C), and a longitudinal cross sectional view (FIG. 9D) of an example of a modular illumination device 900 mounted on a handgun 902 via a plurality of bosses 914 that engage a corresponding plurality of undercut retention slots 912 on the underside of handgun 902. As illustrated in FIGS. 9A and B, in various embodiments, the illumination module 900 may be uncoupled from the handgun 902 by sliding the module forward and down. As illustrated in FIG. 9D, when mounted, bosses 914 may include hook-like elements 914*a* that may engage correspondingly-shaped undercut retention slots 912.

Figure 10:
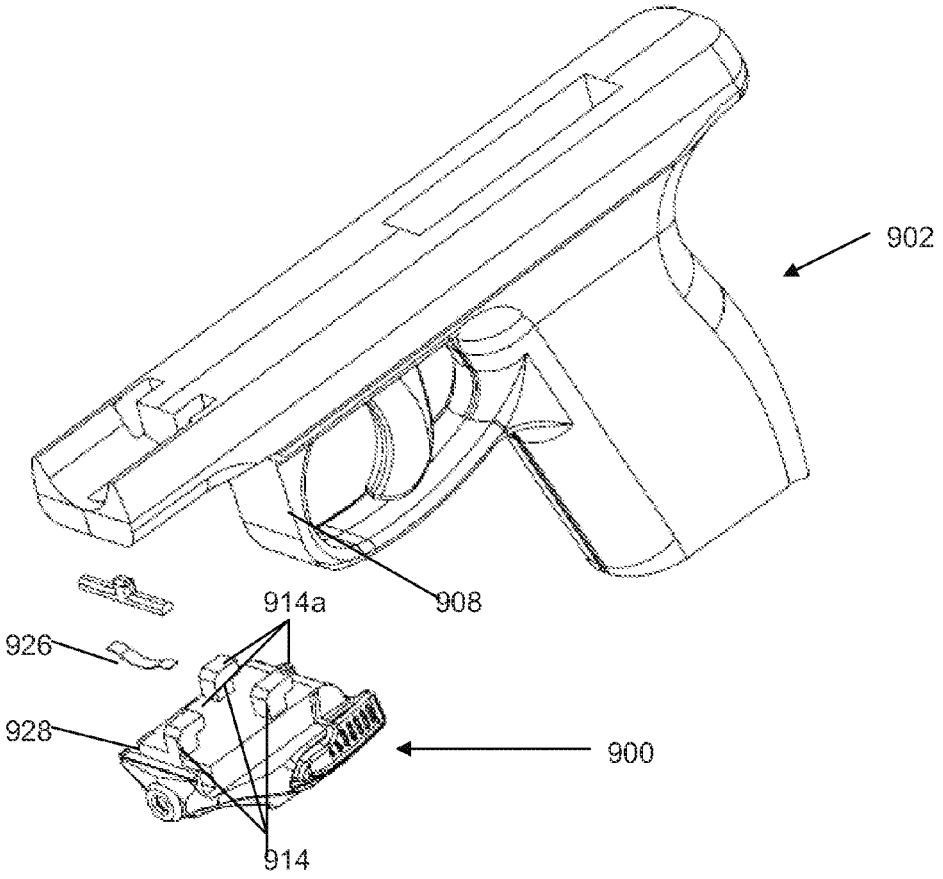
FIG. 10 illustrates an exploded perspective view of the modular illumination device illustrated in FIGS. 9A-D, in accordance with various embodiments.

FIG. 10 illustrates an exploded perspective view of the modular illumination device illustrated in FIGS. 9A-D, in accordance with various embodiments. Turning now to FIG. 10, as described above, in various embodiments, illumination module 900 may be adapted to couple to handgun 902 via a plurality of undercut retention slots (not shown) that may be positioned in front of the trigger guard 908 and on the underside of handgun 902. In various embodiments, illumination module 900 may include a plurality of bosses 914 that may have hook-like projections 914*a* configured to engage corresponding undercut retention slots. In various embodiments, both the bosses 914 and retention slots may be concealed and/or protected by the outside contours of the handgun 902 and/or illumination module 900 when the illumination module 900 is coupled to the handgun 902. Additionally, although the illustrated embodiment shows bosses 914 as the male components and retention slots 912 as the corresponding female components, one of skill in the art will appreciate that these components may be reversed, with retention slots 912 located on the illumination module and corresponding bosses 914 located on the handgun 902. In some embodiments, a spring member 926, such as a leaf spring, may be provided to maintain sufficient tension on bosses 914 and undercut retention slots 912 to prevent accidental uncoupling of the module 900 from the handgun 902.

In some embodiments, a user may couple illumination module 900 to undercut retention slots 912 by aligning corresponding bosses and retention slots 712, 714, inserting bosses 914 into undercut retention slots 912, and sliding illumination module 900 towards trigger 908 until spring member 926 clicks into place into corresponding groove 928 on illumination module 900.

Figure 11A:
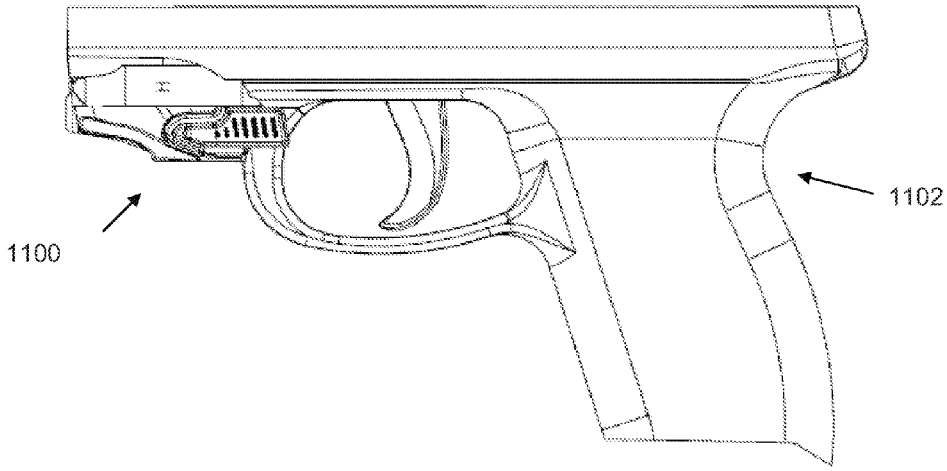
FIGS. 11A-C illustrate a side view (FIG. 11A), a front view (FIG. 11B), and a longitudinal cross sectional view (FIG. 11C) of an example of a modular illumination device mounted on a handgun, in accordance with various embodiments.
Figure 11B:
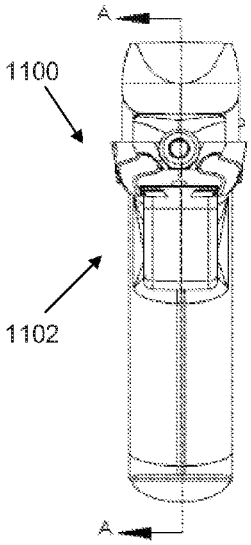
Figure 11C:
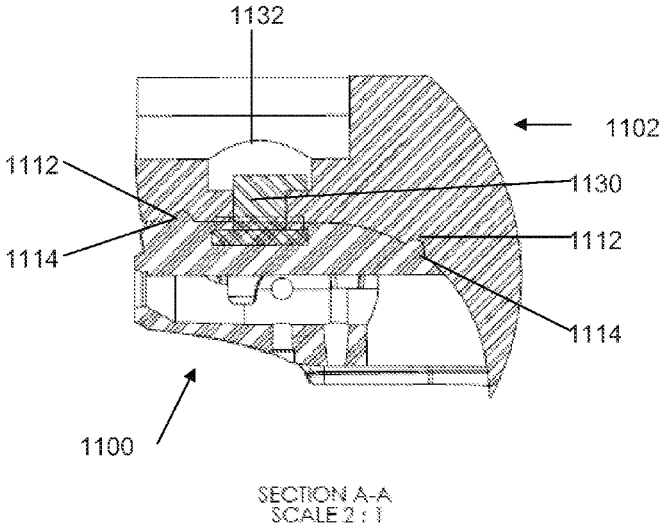

Still other modular illumination devices may couple to the handgun via a locating rail and rotating cam mechanism. For instance, FIGS. 11A-C illustrate a side view (FIG. 11A), a front view (FIG. 11B), and a longitudinal cross sectional view (FIG. 11C) of an example of a modular illumination device 1100 mounted on a handgun 1102 via a locating rib 1114 that engages a corresponding mating groove 1112 on the underside of handgun 1102. As illustrated in FIG. 11C, when mounted, a rotating cam 1130 may engage a corresponding cam receiver 1132 to secure illumination module 1100 in place.

Figures 12A, 12B:
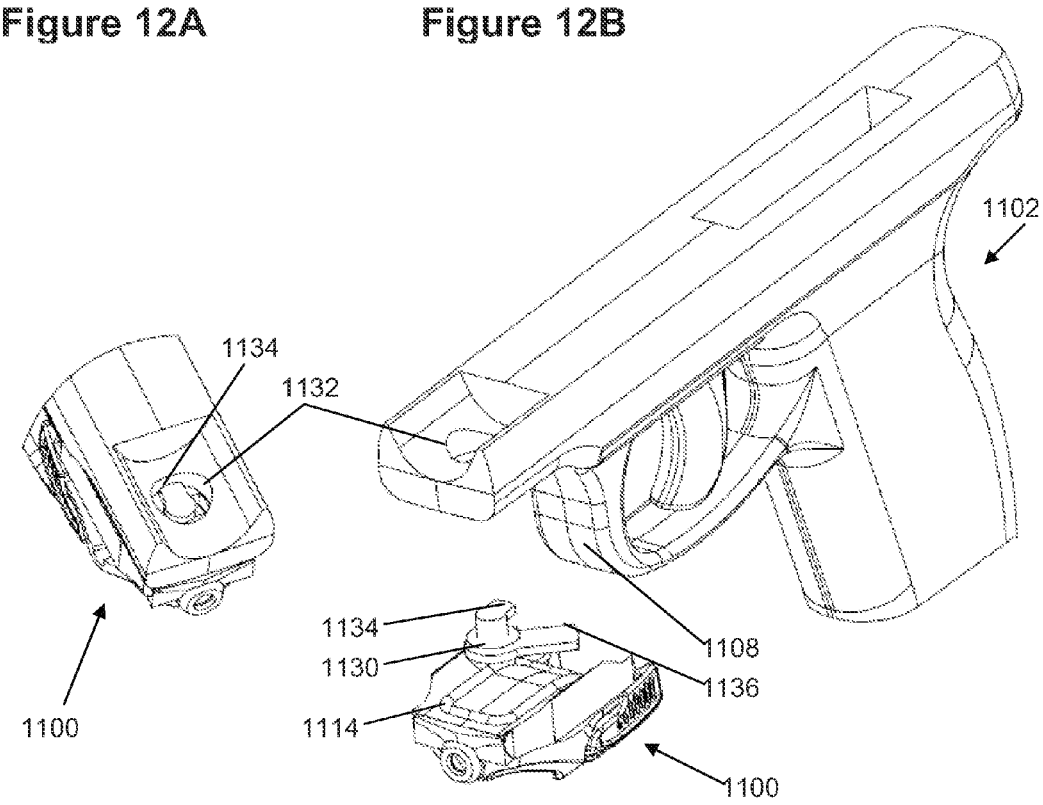
FIGS. 12A and 12B illustrate a top perspective view (FIG. 12A) and an exploded perspective view (FIG. 12B) of the modular illumination device illustrated in FIGS. 11A-C, in accordance with various embodiments.

FIGS. 12A and 12B illustrate a top perspective view (FIG. 12A) and an exploded perspective view (FIG. 12B) of the modular illumination device illustrated in FIGS. 11A-C, in accordance with various embodiments. Turning now to FIG. 12, as described above, in various embodiments, illumination module 1100 may be adapted to couple to handgun 1102 via a locating rib 1114 and rotating cam 1130 that are adapted to engage a corresponding mating groove (not shown) and cam receiver 1132 on the underside of handgun 1102 in front of trigger guard 1108. In various embodiments, locating rib 1114 and its corresponding mating groove may provide tactile feedback to the user that the illumination module 1100 is positioned correctly on the handgun 1102 body. Rotating cam 1130, which may include a cam projection 1134 adapted to engage an undercut cam receiver 1132 in the handgun 1102 body, may then be rotated to securely couple illumination module 1100 to handgun 1102. In some embodiments, rotating cam 1130 may be rotated by the user via a cam lever 1136.

Although the illustrated embodiment shows locating rib 1114 as the male component on the illumination module 1100 and mating groove 1112 as the corresponding female component on the handgun 1102, one of skill in the art will appreciate that these components may be reversed, with locating rib 1114 located on the handgun 1102 and corresponding mating groove 1112 located on the illumination module 1100.

Although a variety of engagement mechanisms are described herein that may be used to couple an illumination device to a handgun, one of skill in the art will appreciate that other engagement mechanisms may be substituted, such as a dovetail joint, locking screws, etc., so long as the mounting members and mounting elements are completely concealed by the outer housing of the handgun and/or illumination device.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

We claim:

1. A modular illumination system and a handgun, comprising:

a handgun having a handgun body, wherein the handgun body comprises:

a barrel having a longitudinal axis, an upper surface, and a lower surface, and having a recess disposed in the lower surface;

a trigger guard extending from the lower surface of the barrel; and a mounting rail positioned below the barrel and extending from a front surface of the trigger guard, the mounting rail being oriented substantially perpendicularly to the longitudinal axis of the barrel; and a modular illumination device comprising:

a mounting element configured to removably couple the modular illumination device to the mounting rail;

a light source disposed within the modular illumination device; and a power source disposed with the modular illumination device and configured to power the modular illumination device;

wherein coupling the mounting element to the mounting rail causes a portion of the illumination device to be inserted into the recess in the lower surface of the barrel and positions the light source below the barrel and in front of the trigger guard on the handgun.

2. The modular illumination system and handgun of claim 1, wherein the modular illumination device is a sighting device and/or a lighting device.

3. The modular illumination system and handgun of claim 1, wherein the light source comprises a visible light laser diode, an infrared laser diode, an LED, an infrared light source, or a combination thereof.

4. The modular illumination system and handgun of claim 1, wherein neither the mounting rail nor the mounting element is visible when the modular illumination device is mounted on the handgun.

5. The modular illumination system and handgun of claim 1, further comprising a cross pin adapted to lock the mounting element to the mounting rail.

6. The modular illumination system and handgun of claim 1, wherein the mounting element and mounting rail are adapted to form a dovetail joint.

7. The modular illumination system and handgun of claim 6, wherein the modular illumination system further comprises one or more screws adapted to lock the dovetail joint.

8. The modular illumination system and handgun of claim 1, wherein the modular illumination device further comprises an activation switch operably connected to the power source.

9. The modular illumination system and handgun of claim 8, wherein the activation switch is configured to be positioned immediately below the trigger guard when installed on the handgun, such that a user's middle finger of a trigger hand naturally rests on the activation switch when gripping the handgun.

10. The modular illumination system and handgun of claim 1, further comprising a dummy module adapted to be coupled to the handgun via the mounting rail, wherein the modular illumination device and the dummy module are adapted to be swapped by a user.

* * * * *